United States Patent [19]

Haslmayr et al.

[11] 4,332,551

[45] Jun. 1, 1982

[54] PROCESS AND EQUIPMENT FOR FIRING PELLETS

[75] Inventors: Johann Haslmayr; Hannes Feichtner, both of Linz, Austria

[73] Assignee: Voest-Alpine Aktiengesellschaft, Linz, Austria

[21] Appl. No.: 217,134

[22] Filed: Dec. 16, 1980

[30] Foreign Application Priority Data

Jan. 23, 1980 [AT] Austria ..... 339/80

[51] Int. Cl.[3] ..... F27D 7/00

[52] U.S. Cl. ..... 432/19; 75/3; 110/265; 110/266; 431/10; 432/78; 432/137

[58] Field of Search ..... 432/19, 78, 137; 75/3, 75/5; 431/10; 110/265, 266

[56] References Cited

U.S. PATENT DOCUMENTS

| | | | |
|---|---|---|---|
| 2,750,273 | 6/1956 | Lellep | 75/3 |
| 2,750,274 | 6/1956 | Lellep | 75/5 |
| 3,318,590 | 5/1967 | Winterling | 432/78 |
| 3,416,778 | 12/1968 | Chabaglian | 432/78 |

FOREIGN PATENT DOCUMENTS

| | | | |
|---|---|---|---|
| 493567 | 6/1953 | Canada | 432/19 |
| 2055846 | 6/1971 | Fed. Rep. of Germany . | |
| 2546098 | 7/1976 | Fed. Rep. of Germany . | |

*Primary Examiner*—John J. Camby
*Attorney, Agent, or Firm*—Kurt Kelman

[57] ABSTRACT

Pellets to be fired are treated with high-temperature gases which, before being supplied to the pellets, are heated by combustion of fuel in a combustion chamber to a temperature above the temperature at which the pellets are to be treated and high enough to ensure that slag formed during combustion can be tapped in liquid form. Cooler gases are then admixed to the high-temperature gases outside the combustion chamber and before they are supplied to the pellets to cool the gases to the temperature desired for the treatment.

12 Claims, 6 Drawing Figures

PROCESS AND EQUIPMENT FOR FIRING PELLETS

This invention relates to a process and equipment for firing pellets by treating them with heat-treating gases which are preferably obtained from air which has been heated while used to cool previously fired pellets and which, before being delivered to the pellets to be fired, are heated above the temperature at which the pellets are to be fired, by the combustion of fuel in at least one combustion chamber, and are cooled to the required heat-treating temperature by an admixing of cooler gases.

Pellets which have been made in the pretreatment of iron ore and have not yet been fired are described as green pellets, which are then thermally hardened at tempertures of about 1250° to 1350° C. so that they have the strength which is required for the transportation of the pellets and for their reduction in a blast furnace. That thermal hardening should not overheat the pellets above their melting point.

To avoid an overheating of the upper layers of pellets by the burner flames, it has been proposed to provide vertical combustion chambers, which are disposed beside the gas hood which covers the traveling grate for conveying the pellets to be fired and which are fed near their upper end with fuel and with preheated exhaust gases from the cooling zone used to cool the previously fired pellets (German Early Disclosure No. 25 46 098). When the gases have thus been heated to the temperature at which the pellets are to be fired, the gases are supplied through a transfer duct to the gas hood. The combustion chamber is so large that the fuel is completely burnt in the combustion chamber and only the properly heated gases but no flames emerge from the combustion chamber. For the same purpose it is known to provide a suitable shield between the pellets to be fired and the burners disposed in the gas hood (German Early Disclosure No. 20 55 846).

A main disadvantage of these known plants resides in the difficulties which arise in the removal of ash which results particularly from the combustion of solid fuels and which has a melting point near the temperature at which the pellets are fired. To ensure that the liquid slag which is formed will flow off, the molten slag must be heated above its melting point but this can hardly be effected in the combustion chambers because there is an upper limit to the gas temperature in the combustion chamber. For this reason, auxiliary burners are required adjacent to the slag tap so that the latter will not be clogged by the slag to be removed. In spite of these additional measures, only fuels are used which produce an ash having a melting point below the temperature at which the pellets are fired. If the hot gases are to be heated to a lower temperature, e.g., for use in the preliminary firing zone, the known combustion chambers cannot be used at all.

To permit the use of lower-grade fuel which can be utilized to a high degree only when it is burnt at high temperatures, as well as the use of lower treating temperatures, it has already been proposed to heat the gases above the temperature at which the pellets are to be treated and then to admix cooler gases so that the heated gases will be cooled to the temperature at which the pellets are to be treated (U.S. Pat. No. 3,318,590). To prevent a sticking of the ash and slag on the walls of the combustion chambers, the cooler gases are tangentially blown into the combustion chamber so that they form a stream flowing along the walls of the combustion chamber in order to prevent a sticking of the ash on the walls. But together with the hot gases, the ash is cooled to the temperature at which the pellets are treated, and the ash then deposits on the pellets to be treated. This deposition of the ash is to be avoided in accordance with the invention.

It is an object of the invention to provide a process which ensures that the ash which is formed in the combustion chambers by the combustion particularly of solid fuel will be satisfactorily removed in the form of liquid slag even when the pellets are to be treated at relatively low temperatures.

In a process of the kind described first hereinbefore, this object is accomplished according to the invention in that the cooler gases are admixed outside the combustion chamber to the high-temperature gases which have been heated in the combustion chamber above the temperature at which the pellets are to be treated.

Because the cooler gases are admixed outside rather than inside the combustion chamber, the temperature at which the pellets are to be treated does not impose an upper limit for the temperature of the flue gas in the combustion chambers so that a temperature above the melting point of the ash may be maintained in the combustion chambers also adjacent to the slag tap and will ensure a free tapping of the slag without a clogging of the slag tap. A suitable proportioning controller which is responsive to the temperature of the cooler gas is used to adjust the temperature of the hot gas to the temperature at which the pellets are to be treated.

Another advantage is due to the fact that the supply of the cooler gases outside the combustion chamber eliminates the risk that the admixing of these cooler gases will result in a temperature drop in the combustion chamber below the ignition temperature. This means that in starting up the plant a combustion of powdered coal can be initiated as soon as the ignition temperature has been reached in the combustion chamber.

To ensure that the hot gases heated above the temperature at which the pellets are to be treated can be adjusted in a simple manner to said temperature by the admixing of cooler gases, equipment for carrying out the process and comprising a traveling grate for conveying the pellets to be fired, a gas hood which covers said traveling grate and is divided into at least three zones, including a drying zone, a firing zone, a firing zone and a cooling zone, and at least one combustion chamber which serves to produce the high-temperature gases and is connected to the gas hood and provided with a slag tap, is provided with a mixing chamber which is connected between the combustion chamber and the gas hood and also connected to a supply duct for cooler gases. Because the rate at which the cooler gas is supplied is controlled in dependence on the rate at which high-temperature gases leave the combustion chamber, the temperature of the gas leaving the mixing chamber may be adjusted to and maintained at any level between the temperature of the cooler gas and that of the high-temperature gas. Because the flue gas temperature is independent of the temperature at which the pellets are to be treated, a temperature level which will ensure a satisfactory tapping of slag can be adjusted in the combustion chamber.

There are no restrictions regarding the design of the combustion chamber, provided that the temperature in the combustion chamber is sufficiently higher than the melting point of the ash of the fuel used. It will obviously be desirable to cause the flames formed by the combustion of the fuel to extend throughout the length of the combustion chamber so that the hot ends of the flames will act on the slag tap and can ensure satisfactory outflow of the slag. The combustion chambers should be so large that the fuel can be completely burnt at the intended throughput rate. Because it is not necessary to heat in the combustion chamber all gas that is required to treat the pellets, the combustion chambers may be relatively small so that the expenditure involved in them is smaller than in known equipment. Obviously the design of the combustion chambers from the aspect of combustion engineering will depend on the melting temperature of the ash of the fuel to be burnt.

Because relatively low requirements are to be met by the combustion chambers, the latter may consist of conventional cylindrical combustion chambers and their locations may be substantially freely selected. Vertical or inclined combustion chambers may be used.

A particularly compact arrangement will be obtained if the combustion chamber is constituted by an annular jacket space which surrounds the transfer duct between the mixing chamber and the gas hood and is provided with at least one tangentially arranged burner and opens at its top end into the mixing chamber and has a bottom that is downwardly inclined to the slag tap. This design will result in a cyclonelike combustion chamber which has a relatively long afterburning section and will produce strong turbulence so that a complete combustion even of solid fuels which have not been ground to a particularly small particle size is ensured. The flue gas from the combustion chamber enters the mixing chamber, which is disposed above the combustion chamber and in which cooler gases, preferably from the cooling zone, are admixed to the flue gas so that the latter is cooled to the desired temperature. The mixed gases are then fed through the transfer duct to the gas hood, which is disposed over the traveling grate carrying the pellets to be treated with the mixed gases.

Alternatively, the combustion chamber may be disposed within the gas hood and may consist of an open-topped trough disposed between the firing zone and the cooling zone whereas a by-pass conduit extending from the cooling zone is used to conduct a partial stream of the exhaust gases to that side of the trough which faces the firing zone. Because part of the space covered by the gas hood is used as a combustion chamber there is no need for separate ducts for supplying the hot gases produced from the exhaust gases of the cooling zone as the combustion chamber is disposed between the cooling and firing zones. On the other hand, a by-pass duct is required for the cooler gases and serves to conduct a partial stream of the exhaust gases from the cooling zone to the outlet end of the combustion chamber. Besides, the trough which defines the combustion chamber permits the slag to be collected in the lowermost portion of the trough and a satisfactory tapping of the collected slag.

Illustrative embodiments of the invention are shown in simplified form in the drawings, in which.

Figure 1:
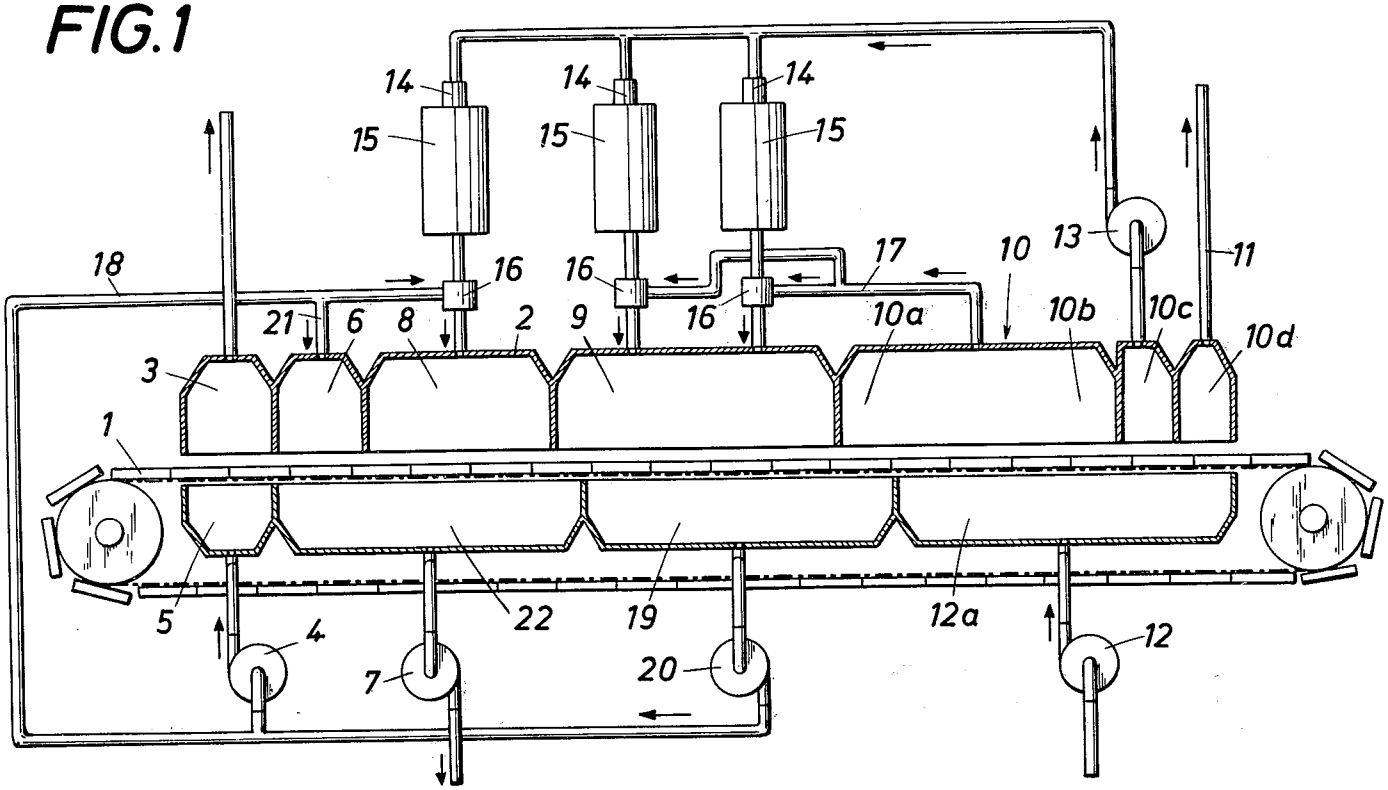
FIG. 1 is a block circuit diagram showing the general arrangement of equipment according to the invention.

The pellets to be fired are charged onto a traveling grate 1 and by means of said grate are fed in succession to various treating zones, which are separated by partitions of a gas hood 2, which covers the traveling grate 1 carrying the pellets to be fired. In each treating zone, the pellets are thermally treated by means of gases heated to a suitable temperature. These treatments are intended to effect a thermal hardening of the pellets in order to increase their strength. To ensure that the green pellets made during the pretreatment of the ore can be subjected to temperatures in the range of about 1250° to 1350° C. in which the desired hardening is effected, the green pellets must first be dried. This is effected in two stages. In the superatmospheric drying zone 3, a preheated gas stream is forced from below through the pellet charge by means of a blower 4 and is suitably distributed by a windbox 5 disposed under the grate. In the succeeding subatmospheric drying zone 6, preheated gas is sucked by a blower 7 to flow through the pellet charge from above, in the opposite direction, so that any moisture which has condensed in the upper layer of the pellet charge during the superatmospheric drying owing to the lower temperature of that layer will be removed. That moisture which is sucked as vapor in a downward direction through the pellet charge in the subatmospheric drying zone cannot condense in the lower layers of the charge because these lower layers have been heated to a higher temperature by the gas in the superatmospheric drying zone.

Drying must be effected at relatively low temperatures in order to prevent a breaking of pellets owing to an excessively fast evaporation of the moisture contained in the pellets. For this reason the dried pellets must be heated up further in a preheating zone 8 before they can be fired. As a result of this additional preheating of the pellets, the thermal shock to which they are subjected as they enter the succeeding firing zone 9 will be reduced. The pellets are then thermally hardened in the firing zone 9 at a temperature of about 1250° to 1350° C. The fired pellets are subsequently cooled in a cooling zone 10, which consists of an afterfiring zone **10*a* and three cooling zone sections 10*b*, 10*c* and 10*d*, which are at different temperatures. The exhaust gases from the last cooling zone section 10*d*, which is at the lowest temperature of about 100° to 200° C., are blown into the open through a duct 11**.

Cooling air is forced by a blower 12 through a windbox **12*a* and the pellet charge from below in order to cool the pellets. When the cooling air has thus been heated, part of the thus heated cooling air is sucked by a blower 13 from the cooling zone section 10*c* and is supplied as combustion air at a temperature of about 350° C. to burners 14**.

By means of said burners 14, supplied fuel is burnt in combustion chambers 15 succeeding the burners 14.

According to the invention, the flue gases are brought to a temperature which exceeds the melting point of the ash resulting from the combustion of the fuel so that the ash can be withdrawn in a simple manner as liquid slag. However, the high-temperature gases leaving the combustion chambers 15 are too hot for treating the pellets in the zone to which the gases are to be supplied. For this reason, mixing chambers 16 are connected between the combustion chambers 15 and the gas hood 2 and are also connected to ducts 17 and 18 for supplying cooler gases. Because a high temperature is required in the firing zone 9, the mixing chambers 16 which precede that firing zone 9 are supplied with exhaust air at about 900° C. from the cooling zone section 10*b*. A lower temperature of about 900° C. is desired in the preheating zone 8 so that cooler gases must be added if the temperature in the combustion chamber is about the same, e.g., 1500° C. In order to utilize the waste heat of the equipment, the exhaust gases from the firing zone 9 are sucked by a blower 20 through a windbox 19 and are conducted through the supply conduit 18 to the mixing chamber 16 which precedes the preheating zone 9. Having a temperature of about 350° C., these exhaust gases from the firing zone 9 can be used to dry pellets and are fed by a blower 4 to the superatmospheric drying zone 3 and through a branch duct 21 to the subatmospheric drying zone 6. When the gases fed to the subatmospheric drying zone 6 and the preheating zone 8 have delivered heat to the pellets, they are sucked by a blower 7 through a windbox 22 and then discharged into the open as they have only a temperature of up to 200° C.

Different from the known equipment for firing pellets, the admixing of cooler gases to the hot gases leaving the combustion chambers 15 may be used to ensure a satisfactory tapping of slag from the combustion chambers 15 as well as the desired temperature in each treating zone so that an adjustment meeting all requirements is permitted.

Figure 2:
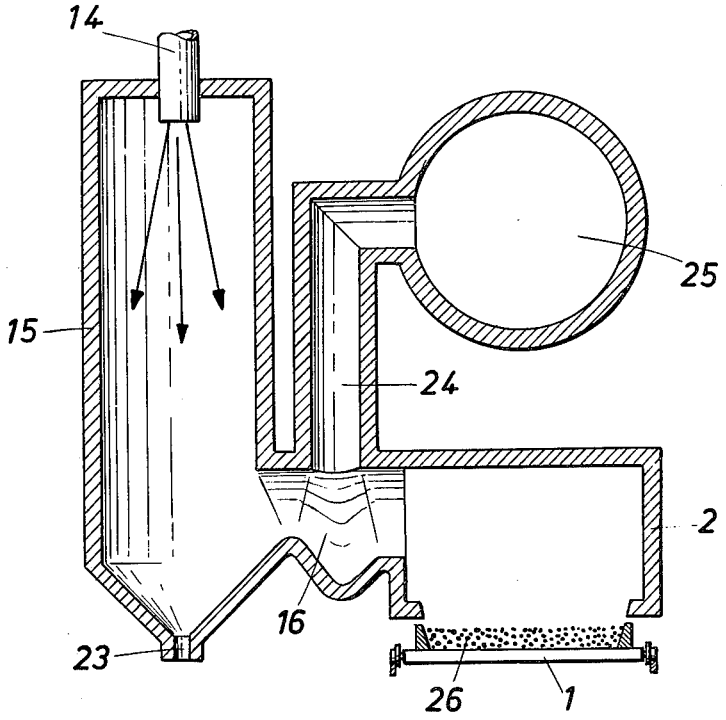
FIG. 2 is a transverse sectional view showing the gas hood of equipment for firing pellets, which gas hood is connected to a burner and covers the traveling grate carrying the pellets to be treated.

In accordance with FIG. 2, a cylindrical combustion chamber 15 is used, which is disposed beside the gas hood 2. By the combustion of fuel in the combustion chamber 15, the gases are heated to a temperature which exceeds the melting point of the ash being formed so that the ash in the form of liquid slag can reliably flow off through a slag tap 23 provided at the bottom of the combustion chamber 15. The high-temperature gases heated in the combustion chamber 15 are fed to the gas hood through a mixing chamber 16, which is connected by a supply conduit 24 to the exhaust gas conduit 25 from the cooling zone 10. The admixing of the cooler exhaust gases from the exhaust gas conduit 25 to the high-temperature gases from the combustion chamber 15 thus results in a cooling of the high-temperature gases to the temperature at which the pellets 26 are to be treated in the respective treating zone. The rate at which the cooler gases are supplied can be controlled by means which are not shown so that any desired temperature can be adjusted.

Figure 3:
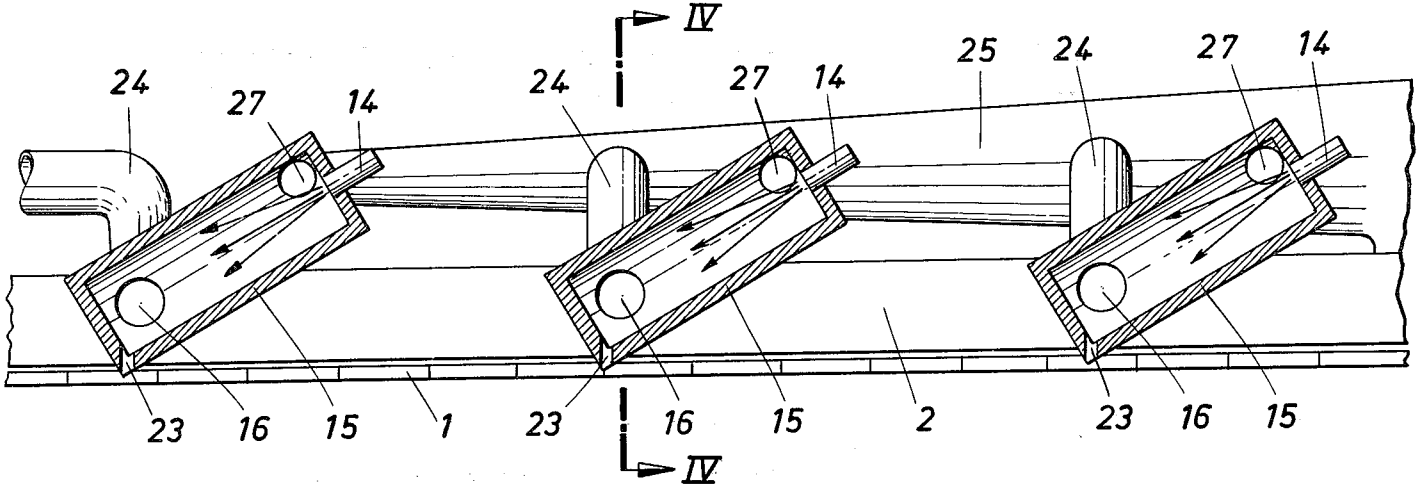
FIG. 3 is a side elevation showing partly in section an equipment which differs from that of FIG. 2 and comprises inclined combustion chambers disposed beside the gas hood.
Figure 4:
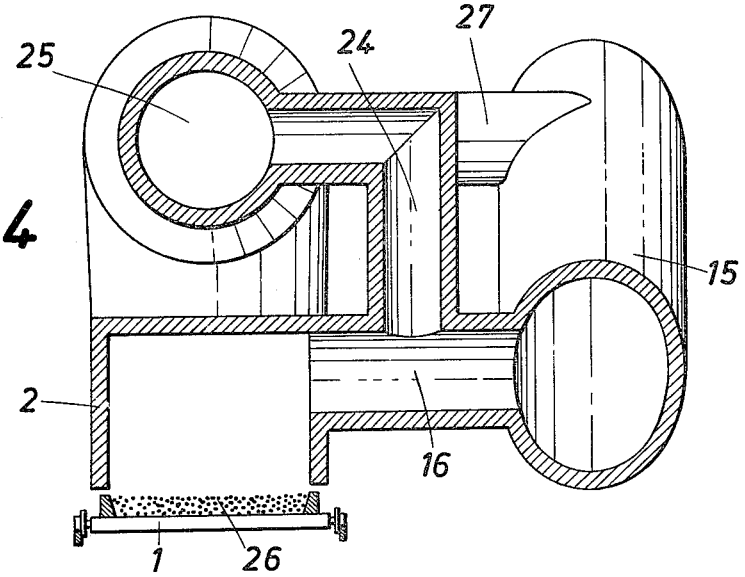
FIG. 4 is an enlarged sectional view taken on line IV—IV in FIG. 3.

As is clearly apparent from FIG. 3 the combustion chambers 15 may be inclined. In this case the slag tap 23 is disposed in the lowermost portion of the combustion chamber 15. To permit a control not only of the temperature of the gases entering the gas hood 2 but also of the temperature in the combustion chambers 15, the latter are connected in accordance with FIGS. 3 and 4 to the exhaust gas conduit 25 by a supply conduit 27 so that the temperature in the combustion chamber can also be influenced by an admixing of exhaust gases from the exhaust gas conduit. The gases will be heated in the combustion chambers to a lower or higher temperature if more or less exhaust gases are fed to the combustion chamber. In this way, the temperature in the combustion chambers 15 can be controlled in relation to the melting point of the ash which is formed. The combustion air supporting the combustion of the fuel is supplied in conventional manner through the burners 14. The temperature in the combustion chambers should be just so high that the slag can easily be tapped in liquid form but should not be excessively high so that it is not necessary to provide the combustion chambers with highly expensive refractory lining.

Figure 5:
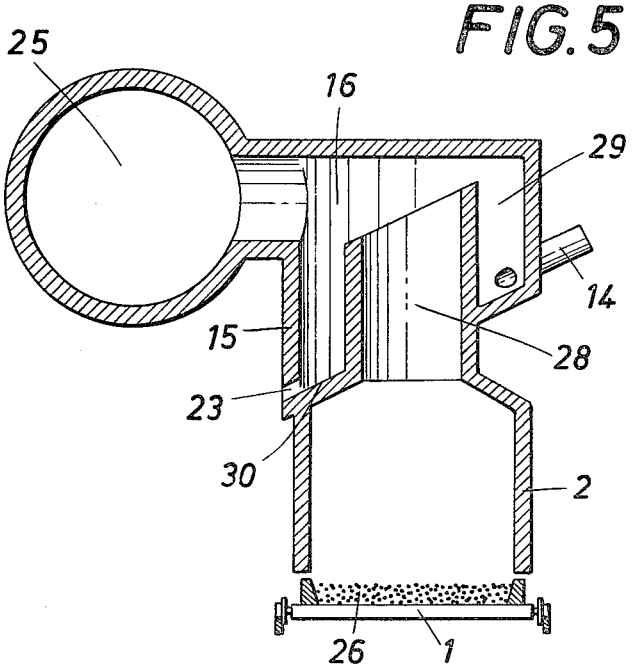
FIG. 5 is a transverse sectional view showing equipment for firing pellets with an annular combustion chamber and FIG. 6 is a longitudinal sectional view showing a combustion chamber which is disposed within the gas hood and consists of an open-topped trough disposed between the firing zone and cooling zone.

FIG. 5 shows a combustion chamber consisting of a cyclone. Specifically, the combustion chamber 15 consists of an annular jacket space 29, which surrounds the conduit 28 connecting the mixing chamber 16 and the gas hood 2 and opens at its top into the mixing chamber 16 and has a bottom 30 which is downwardly inclined to the slag tap 23. More than one burner can obviously be used. The use of the tangential burner 14 causes high-temperature gases to flow in a stream which surrounds the transfer duct 28 so that the high-temperature gases are throughly mixed with the fuel particles and a long afterburning section is obtained. This permits the burning even of coarsely powdered coal. The heated flue gases rise from the jacket space 29 and mix with the cooler gases from the exhaust gas duct 25. As a result, the heat-treating gases flowing from the mixing chamber 16 into the gas hood are at the desired temperature for treating the pellets 26.

Figure 6:
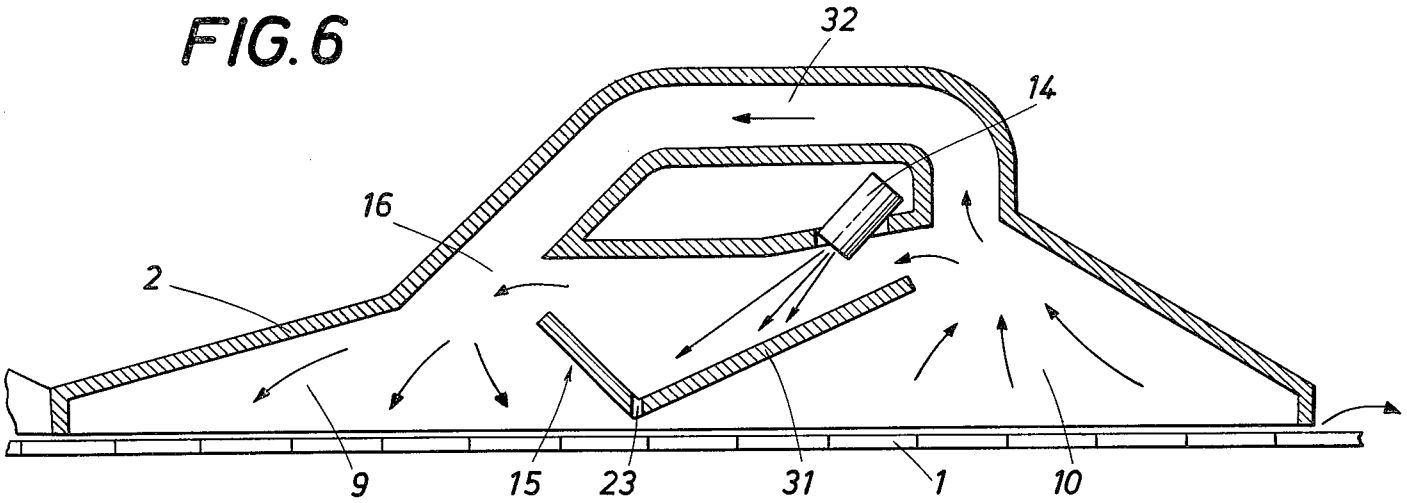

It is apparent from FIG. 6 that the combustion chamber may be arranged within the gas hood 2. In such case the combustion chamber 15 may consist of an open-topped trough 31 between the firing zone 9 and the cooling zone 10 so that the heated exhaust air from the cooling zone 10 can flow directly into the combustion chamber 15 and can be heated there by means of the burner 14. Owing to the trough 31, the high-temperature gases heated above the temperature at which the pellets are to be fired cannot act on the pellets. The temperature in the combustion chamber 15 is so high that the slag which has been formed can flow in liquid form through the slag tap, which is disposed in the lowermost portion of the trough 31.

To permit a cooling of the high-temperature gases from the combustion chamber to the temperature at which the pellets are to be fired, a by-pass duct 32 is provided, which leads from the cooling zone 10 to that side of the trough 31 which faces the firing zone 9 so that there is a mixing chamber 16 on that side of the trough. In the mixing chamber 16, cooler gases can be admixed to the high-temperature gases from the combustion chamber so that said gases are cooled to the temperature at which the pellets are to be fired. The rate at which the exhaust gases flow from the cooling zone 10 through the by-pass duct 32 will determine the final temperature of the heat-treating gases so that said final temperature can be selected by means of a suitable flow rate controller. Such flow rate controller may comprise in the simplest case a damper in the by-pass conduit 32.

What is claimed is:

1. In a process of firing pellets in equipment comprising a combustion chamber and a firing zone wherein the pellets are fired with heat-treating gases at a predetermined firing temperature, the steps of (a) burning fuel in the combustion chamber to produce high-temperature gases at an elevated temperature exceeding the predetermined firing temperature and sufficient to convert ashes produced during the burning of the fuel into a liquid slag,
(b) removing the liquid slag from the combustion chamber, and
(c) admixing cooler gases to the high-temperature gases outside the combustion chamber before the gases are supplied to the pellets to cool the gases to the predetermined firing temperature.

2. In the process of claim 1 wherein the equipment comprises an additional combustion chamber and a heat-treating zone preceding the firing zone, the pellets being heat-treated in the heat-treating zone at a predetermined heat-treating temperature before the pellets are fired in the firing zone, the steps of
(a) burning fuel in the additional combustion chamber to produce additional high-temperature gases at an elevated temperature exceeding the predetermined heat-treating temperature and sufficient to convert ashes produced during the burning of the fuel into liquid slag,
(b) removing the liquid slag from the additional combustion chamber, and
(c) admixing cooler gases to the additional high-temperature gases outside the additional combustion chamber to cool the additional high-temperature gases to the predetermined heat-treating temperature before supplying the additional high-temperature gases to the heat-treating zone.

3. In the process of claim 2, the further step of cooling the fired pellets by contacting the fired pellets with cooling air whereby the cooling air is heated, part of the heated cooling air being supplied to the first-mentioned combustion chamber to produce the first-mentioned high-temperature gases and part of the heated cooling air being supplied to the additional combustion chamber to produce the addition high-temperature gases.

4. In the process of claim 1, the further step of cooling the fired pellets by contacting the fired pellets with cooling air whereby the cooling air is heated, at least a part of the heated cooling air being supplied to the combustion chamber to produce the high-temperature gases.

5. Equipment for firing pellets, comprising
(a) firing means defining a firing zone and operable to contact pellets with heat-treating gases at a predetermined firing temperature in said firinz zone to produce fired pellets,
(b) gas-heating means defining a combustion chamber and operable to burn fuel to produce the heat-treating gases at an elevated temperature exceeding the predetermined firing temperature and sufficient to convert ashes produced during burning of the fuel into liquid slag,
(c) means for removing the liquid slag from the combustion chamber, and
(d) mixing means arranged between the combustion chamber and the firing means for admixing cooler gases to the heat-treating gases coming from the combustion chamber to cool the heat-treating gases to the predetermined firing temperature before supplying the cooled heat-treating gases to the firing zone.

6. The equipment of claim 5, further comprising
(a) heat-treating means defining a heat-treating zone before the firing zone and operable to contact the pellets with additional heat-treating gases at a predetermined heat-treating temperature in the heat-treating zone,
(b) additional gas-heating means defining an additional combustion chamber and operable to burn fuel to produce the additional heat-treating gases at an elevated temperature exceeding the predetermined heat-treating temperature and sufficient to convert ashes produced during burning of the fuel to liquid slag,
(c) means for removing the liquid slag from the additional combustion chamber, and
(d) additional mixing means arranged between the additional combustion chamber and the heat-treating means for admixing cooler gases to the additional heat-treating gases coming from the additional combustion chamber to cool the additional heat-treating gases to the predetermined heat-treating temperature before supplying the additional heat-treating gases to the heat-treating zone.

7. The equipment of claim 6, further comprising
(a) cooling means operable to contact the fired pellets by contacting the fired pellets with cooling air whereby the cooling air is heated,
(b) means for supplying part of the heated cooling air to the first-mentioned combustion chamber for producing the high-temperature gases therein, and
(c) additional means for supplying part of the heated cooling air to the additional combustion chamber for producing the additional heat-treating gases.

8. The equipment of claim 5, further comprising
(a) cooling means operable to cool the fired pellet by contacting the fired pellets with cooling air whereby the cooling air is heated, and
(b) means for supplying at least part of the heated cooling air to the combustion chamber for producing the high-temperature gases therein.

9. The equipment of claim 5, wherein
(a) the firing means comprises a gas hood defining the firing zone, a drying zone at one side thereof and a cooling zone at the other side thereof, and a traveling grate extending under said zones and covered at least in part of its length by the gas hood, the traveling gate being operable to carry the pellets through the drying, firing and cooling zones in that sequence,
(b) the combustion chamber communicates with the gas hood,
(c) the liquid slag removing means is a tap in the combustion chamber,
(d) the mixing means defines a mixing chamber connected between the combustion chamber and the gas hood, and further comprising
(e) a supply duct for supplying the cooler gases to the mixing chamber.

10. The equipment of claim 9, further comprising
(a) cooling means operable to cool the fired pellets by contacting the fired pellets in the cooling zone with cooling air whereby the cooling air is heated, and
(b) air transfer means for supplying at least part of the heated cooling air from the cooling zone to the combustion chamber for producing the high-temperature gases therein.

11. The equipment of claim 10, further comprising an open-topped trough disposed within the gas hood between the firing and cooling zones, the trough defining the combustion chamber, and the air transfer means comprises a by-pass duct extending from the cooling zone to a side of the trough facing the firing zone.

12. The equipment of claim 9, further comprising a transfer duct connecting the mixing chamber to the gas hood, the gas-heating means defining an annular jacket space surrounding the transfer duct and constituting the combustion chamber, the jacket space having a top opening into the mixing chamber and a bottom downwardly inclined toward the slag tap, and the gas-heating means comprises at least one burner extending tangentially to the annular jacket space and operable to burn the fuel.

* * * * *